US005871700A

United States Patent [19]

Konrad

[11] Patent Number: 5,871,700

[45] Date of Patent: Feb. 16, 1999

[54] HOLDING DEVICE WITH A CYLINDRICAL CONTAINER AND BLOOD SAMPLING TUBE WITH SUCH A HOLDING DEVICE

[75] Inventor: Franz Konrad, Regau, Austria

[73] Assignee: C.A. Greiner & Söhne Gesellschaft m.b.H., Kremsmünster, Austria

[21] Appl. No.: 976,367

[22] Filed: Nov. 21, 1997

Related U.S. Application Data

[63] Continuation of Ser. No. 663,183, filed as PCT/AT94/00200, Dec. 21, 1994 published as WO95/17253, Jun. 29, 1995, abandoned.

[30] Foreign Application Priority Data

Dec. 21, 1993 [AT] Austria ..... 2588/93

[51] Int. Cl.[6] ..... B01L 3/08; A61J 1/05

[52] U.S. Cl. ..... 422/102; 422/58; 422/61; 422/99; 422/104; 220/420; 215/10; 215/12.1; 206/446

[58] Field of Search ..... 206/446; 215/10, 215/12.1; 220/420, 430; 422/58, 61, 99, 102, 103, 104

[56] References Cited

U.S. PATENT DOCUMENTS

| | | | |
|---|---|---|---|
| 3,773,468 | 11/1973 | Hubbard et al. | 422/102 |
| 3,807,955 | 4/1974 | Note, Jr. et al. | 422/102 X |
| 4,094,641 | 6/1978 | Friswell | 422/102 X |
| 4,276,987 | 7/1981 | Michel | 215/10 X |
| 4,353,868 | 10/1982 | Joslin et al. | 422/101 |
| 4,652,429 | 3/1987 | Konrad | 422/102 |
| 4,830,217 | 5/1989 | Dufresne et al. | 220/420 |
| 4,915,255 | 4/1990 | Curtis | 220/408 |
| 4,942,966 | 7/1990 | Kemp | 206/521 |
| 5,019,243 | 5/1991 | McEwen et al. | 210/94 |
| 5,096,062 | 3/1992 | Burkardt et al. | 206/361 |
| 5,158,750 | 10/1992 | Finicle | 422/102 |
| 5,160,704 | 11/1992 | Schluter | 422/101 |
| 5,167,929 | 12/1992 | Korf et al. | 422/102 |

FOREIGN PATENT DOCUMENTS

| | | |
|---|---|---|
| 0 295 416 | 12/1988 | European Pat. Off. . |
| 0 341 587 | 11/1989 | European Pat. Off. . |
| 0 466 009 | 1/1992 | European Pat. Off. . |
| 0 512 612 | 11/1992 | European Pat. Off. . |
| 0 571 116 | 11/1993 | European Pat. Off. . |
| 0 580 094 | 1/1994 | European Pat. Off. . |

*Primary Examiner*—Harold Y. Pyon
*Attorney, Agent, or Firm*—Collard & Roe, P.C.

[57] ABSTRACT

A holding device for liquids comprises a container open at one end and formed of a light-tight wall which is sealed at an opposite end, and an outer housing open at one end and formed of a gas-tight wall. The container is inserted coaxially in the outer housing, with a substantial portion of the outer surface of the container wall contacting the inner surface of the housing wall without play whereby the container is held in the outer housing by a press fit. The outer surface of the container wall defines at least one continuous groove extending from the sealed ends of the container and outer housing walls to the open container and outer housing walls.

25 Claims, 3 Drawing Sheets

Fig.1
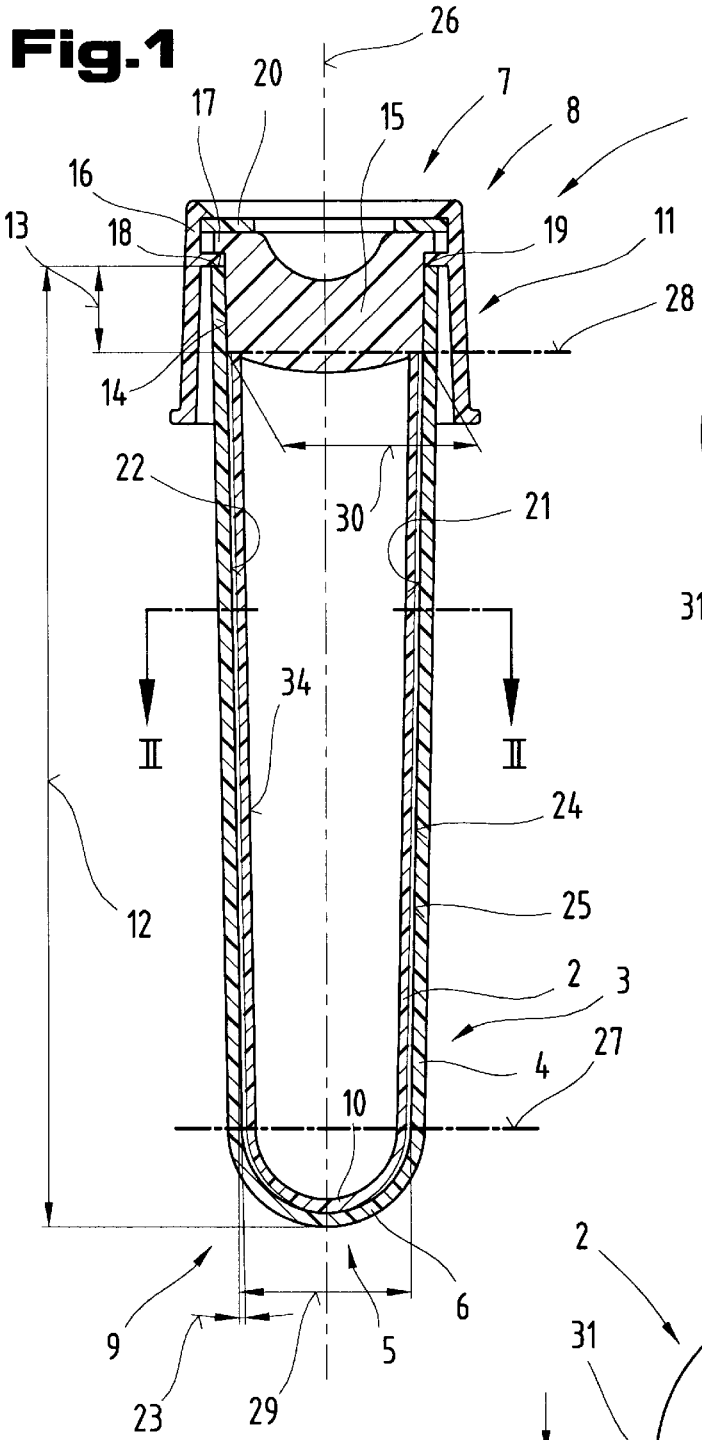
Fig.2
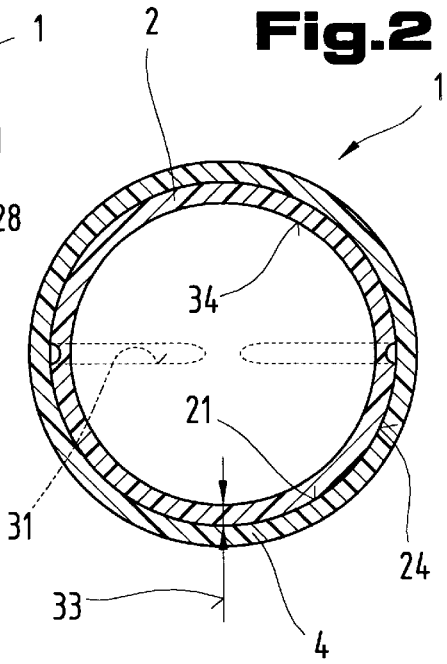
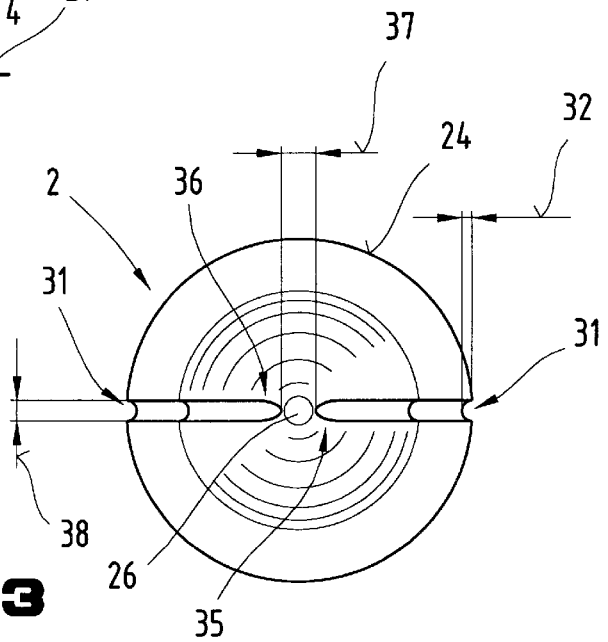
Fig.3

Fig.4
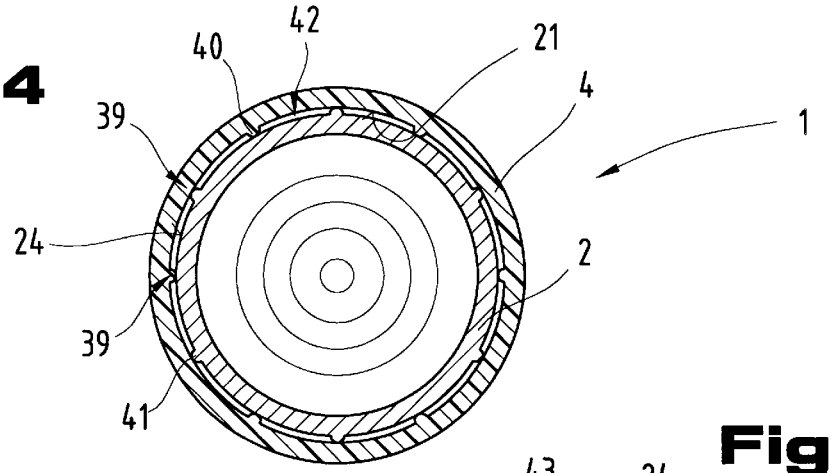
Fig.5
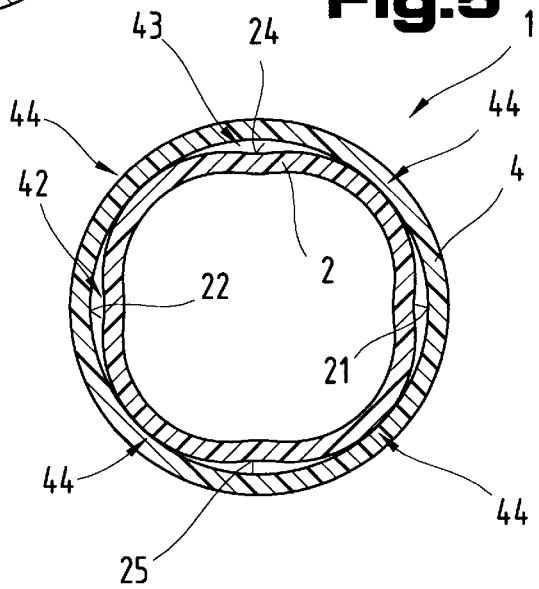
Fig.7
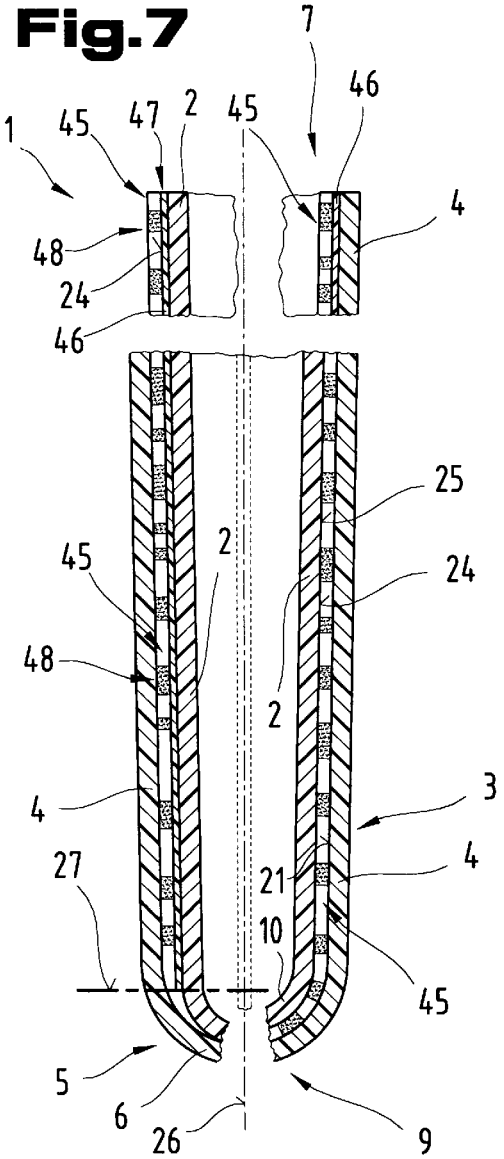
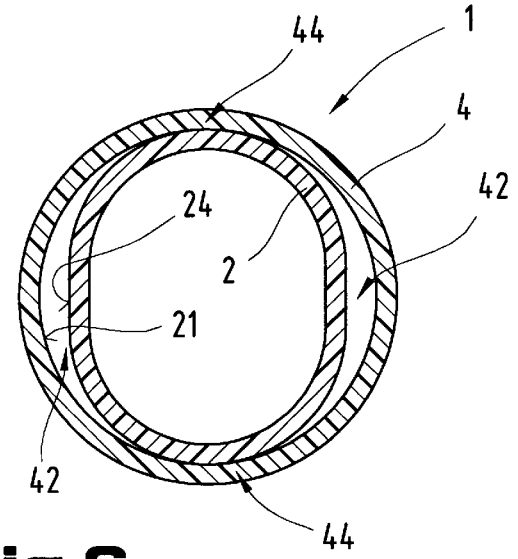
Fig.6

Fig.8
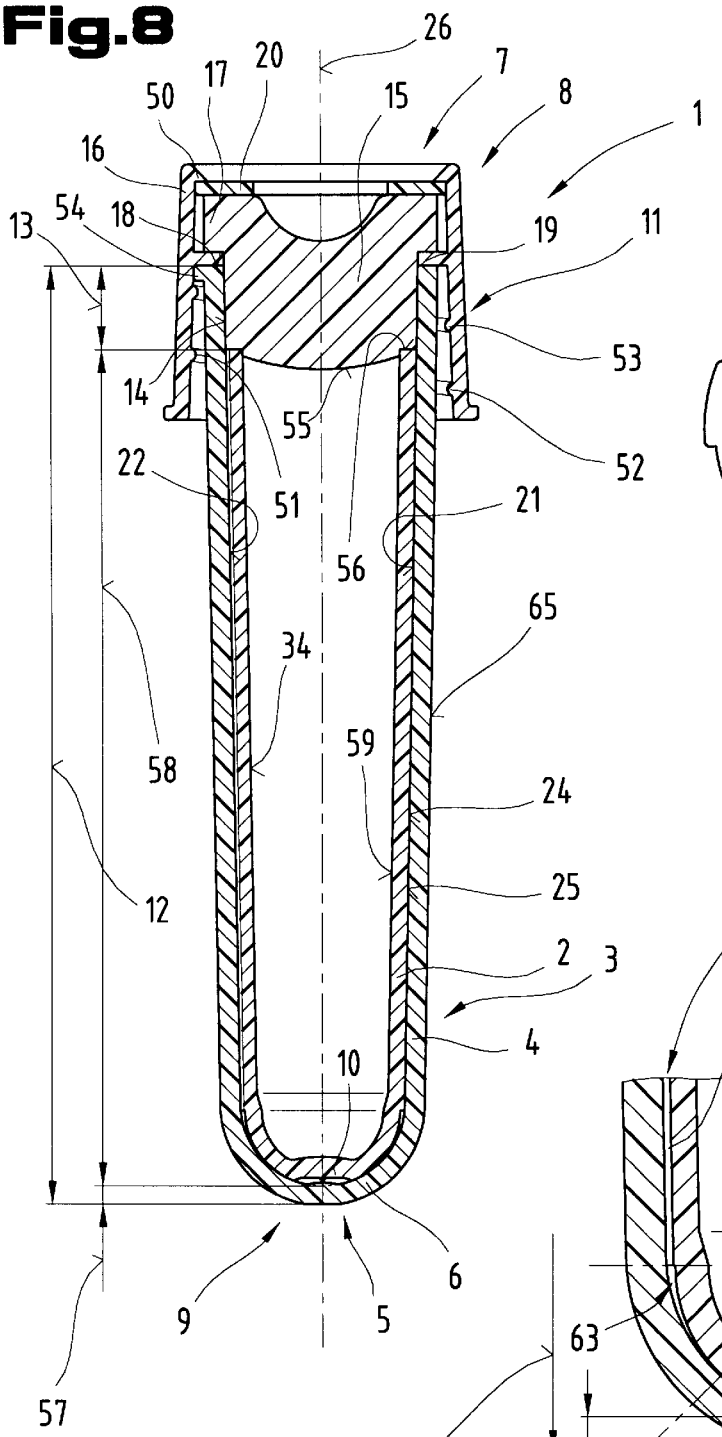
Fig.10
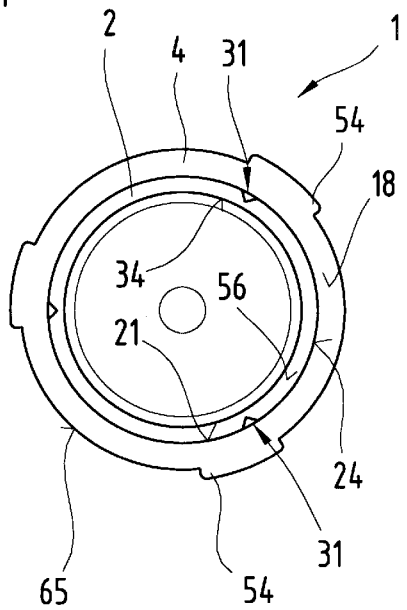
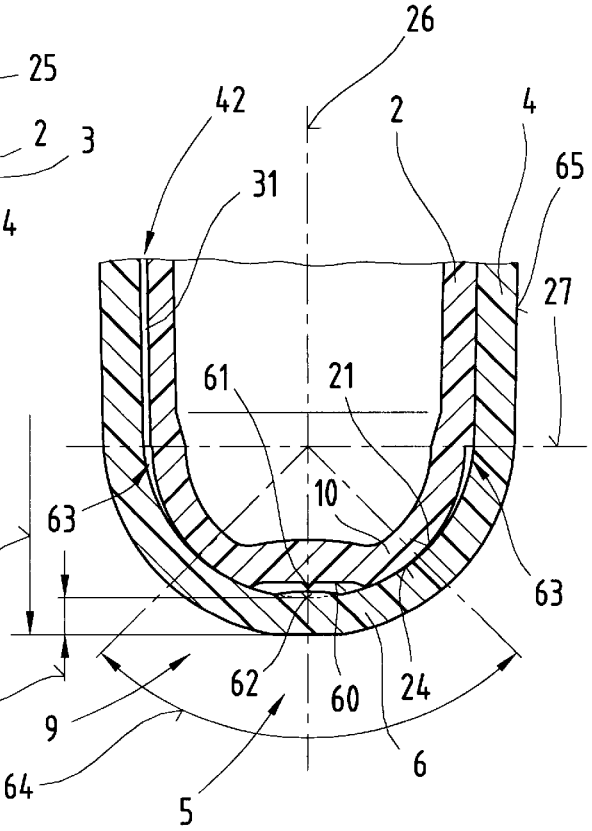
Fig.9

HOLDING DEVICE WITH A CYLINDRICAL CONTAINER AND BLOOD SAMPLING TUBE WITH SUCH A HOLDING DEVICE

This is a continuation of my U.S. patent application Ser. No. 08/663,183, filed Jun. 12, 1996, now abandoned, which is a 371 of PCT/AT94/00200, filed Dec. 21, 1994, published as WO95/17253, Jun. 29, 1995.

BACKGROUND OF THE INVENTION

1. Field of the Invention

The present invention relates to a holding device for liquids, which comprises a container having a longitudinal axis and formed of a liquid-tight wall sealed at one end of the container and the container being open at an opposite end thereof, and an outer housing having a longitudinal axis and formed of a gas-tight wall sealed at one end thereof and the outer housing being open at an opposite end thereof. The container is inserted coaxially in the outer housing.

2. Description of the Prior Art

A transport system for the dispatch of biological samples has become known from U.S. Pat. No. 5,096,062, in which a first container can be inserted in another container and the latter is positioned in the longitudinal direction in the sealed bottom region by means of projecting ribs. Further positioning as well as sealing closure take place by means of a sealing cap in the region of the open ends of the two containers. Between the outer surface of the first container and the inner surface of the second container is arranged a gap which extends all around and over the whole length of the first container. Further, the first container is made of a gas-permeable material and the second container of a gas-tight material. The disadvantage with this embodiment is that between the two containers and in the bottom region thereof are arranged large gaps for containing ambient air.

From U.S. Pat. No. 4,830,217 is known a blood holding device in which a glass container is surrounded by a plastic container at least over part of its longitudinal extent. The glass container in its sealed end region is positioned within the plastic container by means of symmetrically arranged ribs. The glass container in the region of its open end projects beyond the end edge of the outer plastic containers In the region of the end edge of the plastic container is arranged an additional positioning element which holds the glass container both in the longitudinal direction and radially thereto in relation to the plastic container. Between the two containers is arranged a free space extending all around. The open end of the inner glass container is sealed with a sealing plug.

Further, a holding device, in particular for blood samples—according to EP-Al 0 512 612—which consists of a holding container, is already known. This holding container is wrapped with a protective layer which is attached to the holding container. The protective layer is a laminate and transparent, so that the contents of the holding container are visible to an observer from the outside. Identification information may also be printed or indicated on this protective layer. The protective layer prevents the penetration of gas or water vapor, both in the direction of the holding container and from the holding container to the outside. The application of this protective layer which is formed by a film, for example, requires an additional operation usually after evacuation and sealing of the blood sample tube, and needs exact additional quality control to ensure that on the one hand seamless sheathing of the holding container is achieved and on the other hand snug fitting of the file against the outer surface of the holding container takes place in order to obtain gas-tightness and water vapor-tightness.

SUMMARY OF THE INVENTION

It is the object of the present invention to provide a holding device for liquids, in particular for blood, which is easy to make and exhibits high gas-tightness and water vapor-tightness.

The above object is accomplished according to the invention with a holding device for liquids of the first-described kind, wherein a substantial portion of the outer surface of the container wall contacts the inner surface of the outer housing wall without play whereby the container is held in the outer housing by a press fit, and the outer surface of the container wall defining at least one continuous groove extending from the one sealed ends of the container and outer housing walls to the opposite open container and outer housing ends.

The advantage with this solution is that now there are two industrially prefabricated containers which can be assembled by an ordinary joining process and hence the container which holds the liquid is surrounded over the whole of its outer surface seamlessly by the gas-tight and water vapor-tight outer housing. Thus, diffusion of gas or air in or out in the longitudinal direction of the holding container between the container and the outer housing is prevented. As a result, the manufacture of such a holding device for blood is simplified, and also in a surprisingly simple unforeseeable manner, the fracture resistance thereof is increased and a safe outer layer is provided which cannot easily be destroyed even with sharp objects. Due to the elimination of an adhesive layer between the container and the outer housing, furthermore, in an advantageous manner solvent vapors or constituents of the adhesive layer are prevented from evaporating out and diffusing into the interior of the container, as a result of which the risk of contamination of the contents in the container is greatly reduced. Due to close fitting of the container against the outer housing, a cavity, which might lead to a reduction of the vacuum in the container due to diffusion or on account of the high permeability of the container to gases, is avoided as well. Due to the provision of a press fit between the container and the outer housing, reliable mounting and positioning and air-tight sealing between the container and the outer housing are ensured as well. In addition, by this means support of the container in the outer housing can easily be obtained by adhesion or by janming of the container in the outer housing, and the displacement of unwanted residual air within the outer housing can be avoided.

According to one preferred feature, the inner surface of the outer housing wall and the outer surface of the container wall conically converge towards the sealed walls at the sealed ends of the outer housing and container. Due to the at least partly conical design of the outer housing and container, exact positioning of the container in the outer housing can be achieved by means of these cones, and no additional measures are necessary for centering or correct positioning of the container in the outer housing.

If the inner surface of the outer housing wall and the outer surface of the container wall conically converge under the same cone angle, snug fitting of the outer surface of the container against the inner surface of the outer housing is also possible.

The cone angle preferably is between 0.2° and 4.0°. This enables the two containers to be brought into contact with each other practically over their whole length, and so a dead volume which by pressure equalization may lead to a reduction of the vacuum in the interior of the container is reduced.

If the converging outer and inner surfaces have the same diameter at the sealed wall ends, the container can fit snugly in the outer housing even in the region of the sealed end, and the formation of a dead volume in the end region is prevented.

According to another preferred embodiment, the conically converging inner surface of the outer housing has a diameter which is smaller by at least 0.001 mm than the diameter of the outer surface of the container at the sealed wall ends. In this case, even in case of tolerance fluctuations in the diameter of the container and outer housing, it is ensured that the container can be pressed into the outer housing.

If the outer housing wall and/or the container wall is resistant to elongation in the direction of the longitudinal axis, mechanical handling when inserting the container in the outer housing is made easier.

The advantages according to the invention can be utilized to a large extent irrespective of the material of the container.

The advantages of composite or sandwich construction technology can also be used for manufacture of the outer housing and container walls In accordance with yet another preferred embodiment, the container has a substantially elliptical cross-section at least at the sealed and open ends thereof, the elliptical cross-section having a large diameter and a small diameter extending perpendicularly thereof, the small diameter being at least 0.001 mm shorter than the large diameter. With such a container structure, in addition to ease of manufacture, extraction of air from the outer housing can be obtained irrespective of the assembly position during insertion of the container in the outer housing, without weakening or deformation of the container by groove-like depressions or passages being necessary.

If the walls at the sealed ends of the container and outer housing are hemispherically shaped, fitting of the container against the inner surface of the outer housing almost without play can be achieved even in the region of the end walls.

If two diametrically oppositely arranged continuous grooves having ends at respective sides of the longitudinal axis and spaced from each other in the sealed end of the container are provided, circulation of the air from one side of the container to the other using the groove-like depressions can be prevented, as a result of which reduction of the vacuum inside the container by permeation, sorption or desorption is prevented.

If the container wall is gas-permeable, due to the increased air permeability in the region of the end wall on insertion of the container in the outer housing, the air which is compressed in the process can be extracted through the interior of the container and so the build-up of an air bubble between the two end walls can be prevented.

A container wall made of a liquid-tight plastic prevents the escape of liquid and diffusion of water vapor into any existing cavity between container and outer housing.

A wall thickness of between 0.4 mm and 1.2 mm provides sufficient liquid-tightness and safe handling of the container.

An outer housing wall made of such a gas-tight material as polyethylene terephthalate, for example, will prevent diffusion by sorption or permeation of gases or vapors from the outside into the interior of the container.

The wall thickness of the outer housing may also be between 0.4 mm and 1.2 mm to obtain sufficient fracture resistance with a plurality of materials which exhibit sufficient gas-tightness.

Preferably, the outer housing wall has a water vapor permeability of less than 1 $g/m^2.d$ and a gas permeability of less than 150 $cm^3/m^2.d.bar$ In this ease, even if the container has a high gas permeability or water vapor permeability, a high vacuum can be maintained in the interior thereof over a long period, because penetration of the gas by sorption or desorption or permeation through the outer housing is prevented.

If ribs or webs are arranged on the outer surface of the container wall and/or the inner surface of the housing wall, even with lower wall thickness additional reinforcement of the container or outer housing can be achieved by the components needed for air extraction on insertion of the container in the outer housing, wherein, for example, arrangement of the ribs spirally or in the manner of a thread turn is also possible, in order thus to obtain a high increase in strength of the container or outer housing.

With a continuous groove depth of 0.02 mm to 0.5 mm, the rough volume in the groove can be kept small.

With respect to strength, it is advantageous if the continuous groove is a depression in the outer surface of the container wall forming a passage extending parallel to the longitudinal axis from the one end of the container towards the opposite open end.

According to still another embodiment, at least one of the wall surfaces has circumferentially spaced ribs extending parallel to the longitudinal axis and contacting the facing wall surface without play whereby the container is held in the outer housing by a press fit, and the ribs define therebetween continuous grooves extending from the one sealed ends of the container and outer housing walls towards the opposite open container and outer housing ends. This allows universal adaptation of the shape of the air extraction openings to different designs of the outer housing or container.

It is advantageous to arrange a gas-tight plug sealing the open ends of the outer housing and container, the outer housing and container walls having end edges at the open ends, and the plug sitting on the end edge of the container wall and comprising a flange projecting beyond the inner surface of the outer housing wall, the flange sitting on the end edge of the outer housing walls.

The plug may have a coaxially extending cylindrical sealing surface contacting the inner surface of the outer housing wall, the sealing surface having a length exceeding the difference between the lengths of the container and outer housing and extending to the flange. This allows gas-tight sealing of both the interior of the container and any dead space between the container and the outer housing, so that gas or air which has diffused from the container into the outer housing is sealed off from the outside air and cannot diffuse to the outside, so that an indirect reduction of the vacuum in the container is reliably prevented.

BRIEF DESCRIPTION OF THE DRAWING

The above and other objects and features of this invention will be described in the following detailed description of certain now preferred embodiments, taken in conjunction with the accompanying drawing which show in FIG. 1 a holding device designed according to the invention, e.g. for blood, with an outer housing designed according to the invention and a container in a simplified schematic side view, in section;

FIG. 2 the holding device in a top view, in section through the lines II—II in FIG. 1;

FIG. 3 the container of the holding device in a simplified schematic view from below;

FIG. 4 another embodiment of a holding device in a top view, in section, with webs or ribs arranged on the outer surface of the container and the inner surface of the outer housing;

FIGS. 5 another embodiment of a holding device in a top view, in section, with a container with passages;

FIG. 6 another variant of the holding device with a container of which the cross-section is not round;

FIG. 7 a holding device in a side view, in section, and a painted or printed layer with information arranged between the outer housing and the container;

FIG. 8 another embodiment of a holding device in a simplified schematic side view, in section;

FIG. 9 part of the holding device according to FIG. 8, in an enlarged side view, in section;

FIG. 10 the holding device according to FIGS. 8 and 9 in a top view and with the sealing device removed.

DESCRIPTION OF THE PREFERRED EMBODIMENTS

In FIGS. 1 to 3 is shown a holding device 1 which consists of a cylindrical container 2 and, surrounding the latter, an outer housing 4 acting as a protective layer 3. One end 5 of the outer housing 4 is sealed by an end wall 6 which may be hemispherically cup-shaped, for example, while one end 7 of the outer housing 4 opposite the end 5 is open, but can be sealed with a sealing device 8 which can be removed if need be.

Also, the container 2 of the holding device 1 is sealed at one end 9 by means of an end wall 10 and likewise can be sealed by the sealing device 8 in the opposite end region 11 facing towards the end 7 of the outer housing 4.

Preferred is a length 12 of the outer housing 4 longer by a length difference 13 than a length of the container 2. This length difference 13 usually also corresponds to the length of a sealing surf ace 14 of a stopper 15 forming the sealing device 8, but can be longer. Preferably the sealing surface 14 overlaps the end region 11 in the longitudinal direction of the container 2 at least slightly .

This stopper 15 is usually clamped in a cap 16 over a flange-like attachment 17 between a peripheral collar 19 resting on an end edge 18 of the outer housing 4, and a retaining washer 20. In order also to achieve gas-tight and liquid-tight sealing of the open end 7 of the outer housing 4 or of the open end region 11 of the container 2, the stopper 15 is formed from a highly elastic and self-sealing material such as e.g. pharmaceutical rubber, silicone rubber or bromobutyl rubber.

For support of the container 2 in the outer housing 4 without play, an inner surface 21 of the outer housing 4 is designed as an inner cone 22 with a cone angle 23, wherein the inner cone 22 tapers from the end edge 18 of the open end 7 of the outer housing 4 in the direction of the end wall 6.

An outer surface 24 of the container 2 on the other hand is provided with an outer cone 25 which preferably has the same or e.g. a slightly larger cone angle 23 as the inner cone 22.

Both the inner cone 22 and the outer cone 25 extend concentrically with a longitudinal axis 26 of the holding device 1.

In planes 27 and 23 shown schematically by dot and dash lines, a tip diameter 29, for example in the plane 27 of the outer cone 25, corresponds to that of the inner cone 22, or the tip diameter 29 of the outer cone 25 is larger by a slight tolerance, for example between 0.001 mm to 0.2 mm, than the tip diameter 29 of the inner cone 22.

Furthermore, a base diameter 30 of the outer cone and inner cone 22 is preferably the same.

By such a design of the container 2 or outer housing 4, in particular using a cone angle 23 which is between 4° and 0.2°, preferably about 1°, snug telescoping or insertion and positioning of the container 2 and a press fit are possible. Due to the design of the cone angle 23, self-locking between the container 2 and the outer housing 4 can be obtained, or is possible in the outer housing 4.

As can be seen better from FIGS. 2 and 3, the container 2 in the region of its outer surface 24 is provided with groove-like depressions 31 which have a depth 32 preferably less than a wall thickness 33 of the container 2, so that the latter comprises a continuously smooth inner surface 34. This wall thickness 33 of the container 2 is between 0.4 mm and 1.2 mm, preferably 0.6 mm to 1.0 mm. The outer housing 4 can also have the wall thicknesses previously mentioned for the container 2.

These groove-like depressions 31 extend from the open end region 11 of the container 2 into the region in which the longitudinal axis 26 intersects with the end wall 10. Preferably, the facing ends 35, 36 of the two groove-like depressions 31 are spaced apart by a distance 37 of between 0.5 mm and 4 mm, and have a depth 32 of between 0.02 mm and 0.5 mm as well as a width 38 of 0.2 mm to 3 mm, preferably 2 mm. In the view selected here, only two depressions are shown. But it is of course possible to provide any number of depressions there, seen over the circumference.

Preferably, in their ends 35, 36 they taper continuously into the outer surface 24 of the container 2.

The advantage of this interruption or separation of the two groove-like depressions 31 lies in that alternate throughflow of air or gas over the whole outer surface 24 of the container 2 is avoided.

By the depth 32 and width 38 of the groove-like depression 31, however, there is provided such a throughflow cross-section which allows, on insertion of the container 2 in the outer housing 41 the air compressed between the end wall 6 and the end wall 10 to escape in the direction of the open end 7 of the holding device 1 and from there to emerge into the atmosphere. Thus without considerable compressive stress on the container 2 or outer housing 4, snug fixing or a press fit between the two of them is provided.

Mounting of the container 2 in the outer housing 4, which takes place by a press fit, can also take place or at least be assisted by heating or cooling the outer housing 4 or container 2, so that within the usual temperature range in which such holding devices are used, a firm press fit is obtained between the container 2 and the outer housing 4. In this case in certain circumstances it is even possible to manage without the groove-like depressions 31 and yet provide problem-free assembly without the formation of a sealed air cushion between the end walls 6 and 10 of the outer housing 4 and container 2.

Due to this solution, in spite of easier assembly, the volume of the cavities required for exit of the air during assembly is kept so stall that, even in case of high permeability of the container to gases, in particular air, and resulting pressure equalisation between the cavity and the interior of the container, an adequate vacuum can still be maintained in the interior of the container over a longer period, in particular the desired storage time.

Usually the pressure in the interior of the container 2 in the unused state ready for operation, that is, evacuated, is between 100 mbars and 800 mbars, so that a vacuum of between 0.2 bar and 0.9 bar is available.

It is further advantageous if the container 2 is made of a liquid-tight, in particular water-tight material, such as erg. glass, plastic, in particular polypropylene (PP), polyethylene (PE), high density polyethylene (NDPE)I ABS or the like.

The outer housing 4 and/or the container 2 is resistant to deformation, in particular resistant to elongation, in the direction of the longitudinal axis 26, as a result of which even in case of temperature fluctuations no independent release of the cone connection can occur. A gas-tight material, in particular polyethylene terephthalate (PET), is used as the preferred material for the outer housing. This material has the advantage that it can be made with higher transparency (clear) than a high density polyethylene (HDPE) which can be used similarly. Critical for these materials used for manufacture of the outer housing 4 is that their gas permeability and water vapour permeability are very low. Thus the gas permeability should be less than 150 $cm^3/m^2 \cdot d \cdot bar$, and the water vapour permeability should be less than 1 $g/m^2 \cdot d$. These values are obtained for example with polyethylene terephthalate (PET), because at 23° C. the water vapour permeability is 0.6 $g/m^2 \cdot d$ and the gas permeability is 80/110 $cm^3/m^2 \cdot d \cdot bar$.

For the user of such a holding device 1 it is particularly advantageous if the container 2 and/or the outer housing 4 is made of a transparent, in particular clear, material, because in this way proper inspection of the interior of the holding device 1 is ensured, in order to be able to detect satisfactorily the level, for example.

It turned out to be a particularly advantageous choice for the materials of the container 2 as well as of the outer housing 4 if the container 2 is made of liquid-tight material and the outer housing 4 is made of gas-tight material.

In FIG. 4 is shown another embodiment of a holding device 1 in a top view, in section, the same reference numbers as in Pigs 1 to 3 being used for the same components.

The holding device 1 again consists of the container 2 supported in the outer housing 4, wherein on the inner surface 21 of the outer housing 4 and an the outer surface 24 of the container 2 are arranged projections 39 in the form of ribs 40 or webs 41. In this embodiment shown here, both on the inner surface 21 and on the outer surface 24 are arranged these projections 39. But it is of course also possible to arrange the projections 39 either only on the inner surface 21 of the outer housing 4 or only on the outer surface 24 of the container 2. It is critical here that the air present on insertion of the container 2 in the outer housing 4 can escape from the interior of the outer housing 4 through channels 42 formed between the projections 39 and so the container 2 can be inserted with its end wall 10 into the region of the end wall 6 of the outer housing 4.

The design and size of the projections 39 or of the channels 42 formed between them must be selected so that on the one hand the air present in the outer housing 4 can escape on insertion of the container 2, but after insertion of the container 2 a secure fit between container 2 and outer housing 4 is ensured. For a better understanding, the projections 39 and channels 42 are shown enlarged not to scale and are between 0.02 mm and 0.5 mm.

The choice of inner and outer cones 22, 25 with the cone angle 23 can correspond to the embodiments already described above, which ensures that there is self-locking in the fitted-together state between the container 2 and the outer housing 4.

It is of course also possible that the outer shape of the container 2 and the inner shape of the outer housing 4 are coordinated with each other in such a way that they fit together almost without play, for example with a difference in circumference or diameter of 0.001 mm or the like, in which case fixing of the container 2 in the outer housing 4 can then take place by an adhesive layer, a thermal welding process or the like joining methods.

But of course it is also possible that this difference in diameter or size in the circumferential dimensions between the container 2 and the outer housing 4 is produced by the fact that either the outer housing 4 is heated or the container 2 is cooled to −100° C. to −200° C., in order to allow insertion of the container 2 in the outer housing 4 without problems. By this method it is also possible, on account of heating or shrinkage by cooling, to predetermine the latching force or pretensioning force between the container 2 and the outer housing 4, which exists within the range of the usual temperature of use of the holding device 1.

In FIG. 5 is shown another embodiment of the holding device 1 in a top view, in section.

The outer housing 4 with its inner surface 21, as shown i the preceding embodiments, also has a round cross-section with a cross-section tapering towards the end wall 6.

The container 2 in this embodiment comprises on its outer surface 24 passages 43 which are in each case offset from each other by about 90° and which again thus form channels 42 between the inner surf ace 21 of the outer housing 4 and the outer surface 24 of the container 2, for escape of the air from the interior of the outer housing 4

Between the zones formed by the passages 43 or channels 42 are formed support regions 44 in which the shape of the outer surface 24 of the container 2 is adapted to the shape of the inner surface 21 of the outer housing 4, and these therefore fit together. The outer housing 4 can again be designed with the inner cone 22, and the container 2 with the outer cone 25, wherein the cone angle 23 can be such that between the inner surface 21 and the outer surface 24 self-locking occurs. The cone angle 23 is then between 4° and 0.2°, preferably 1°. Instead of the continuous conical shape of the container 2 and outer housing 4, it is of course also possible to design these two with a cylindrical longitudinal shape and mount them stationarily one inside the other by projecting clamping or locking lugs. On the other hand it is also possible to make both the container 2 and the outer housing 4 conical only in corresponding parts of their length, so that in these regions mounting and fixing of the container 2 in the outer housing 4 takes place.

The distribution of the passages 43, as seen over the cross-section of the outer surface 24, is here shown only by way of example and can be designed differently, depending on the application or choice of materials, so that instead of the four passages shown in FIGS. 5, three or six or any other number can be provided.

In FIG. 6 is shown another variant of the holding device 1 in cross-section, the same reference numbers again being used for the same components.

The outer housing 4, as already described in the preceding embodiment, again has a round cross-section which can taper in the direction of its end wall 6 by the cone angle 23 or be designed as described above. The container 2 in this embodiment is of oval construction, its outer surface 24 being supported in two diametrically opposed support regions 44 on the inner surface 21 of the outer housing 4. Between the support regions 44 are again formed channels 42 which serve to extract the air from the interior of the outer housing 4. As can further be seen from this view, the container 2 has a maximum length in the direction of an axis between the support regions 44 and a small dimension in an axial direction perpendicular thereto, wherein the difference in dimensions of the container 2 in the axes extending perpendicularly to each other is at least 0.001 mm.

In FIG. 7 is shown another embodiment of the holding device in a side view, in section, the same reference numbers again being used for the same components.

In this view are shown the different possible arrangements of painted or printed layers 45 between the container 2 and the outer housing 4. The container 2 is again designed at its outer surface 24 with the outer cone 25 tapering in the direction of its end wall 10. On the outer surface 24 on the left of this figure it is show that a film 46 is arranged there, surrounding the outer surface 24. This film 46 can be designed as a substrate layer 47 for the painted or printed-layer 45 and/or as a gas-tight barrier layer. The painted or printed layer 45 may consist of information 48 shown schematically which e.g. indicates to the user of this holding device 1 different fields of application, if occasion arises additives arranged in the container 2, the expiry date, the partial pressure built up in the interior, manufacturer's information, warnings or, by different colour coding, different spheres of applications.

The film 46 applied to the outer surface 24 in this embodiment extends into the region of the plane 27 of the holding device 1 shown by dot and dash lines.

But it is of course also possible, as shown in the top right region of FIG. 7, to apply the film 46 with the painted or printed layer 45 to the inner surface 21 of the outer housing 4.

In the bottom right region of FIG. 7 it is also shown as an additional variant that the painted or printed layer 45 with its information 48 is introduced without interposition of the film 46 between the outer surface 24 of the container 2 and the inner surface 21 of the outer housing 4. This can take place either by the fact that the painted or printed layer 45 has been applied either to the inner surface 21 or to the outer surface 24 in each case before insertion of the container 2 in the outer housing 4. The painted or printed layer 45 is in this embodiment continuous in the region between the end wall 10 and the end wall 6 over the whole cross-section. In order to allow sufficient air extraction on insertion of the container 2 in the outer housing 4, in this embodiment it is now possible for example to apply the film 46 over two partial regions, so that between the individual film portions, narrow continuous channels 49 are obtained for escape of the air on insertion of the container 2 in the outer housing 4.

Equally it is also possible to interrupt the painted or printed layer 45 applied to the inner surface 21 of the outer housing 4 or the outer surface 24 of the container 2, continuously in the longitudinal direction of the holding device 1, so that the channels formed thereby can be used to extact air on insertion of the container 2 in the outer housing 4.

Of course it is also possible to arrange the painted or printed layer 45 between two films, that is, in a film sandwich composite, and to apply this film composite to parts or the whole circumference of the container 2 or to the inner surface 21 of the outer housing 4. Attachment of the films 46 and application of the painted or printed layer 45 or corresponding film composites can take place for example by adhesion or integral formation during the process of manufacturing the container 2 and outer housing 4, which usually takes place by injection moulding, in which the painted or printed layer 45 or the film 46 or the composite films are positioned on the mould surfaces of the tools, in order to join them, during the process of manufacturing the container 2 and outer housing 4, directly to them.

In connection with manufacture of the outer housing 4 and/or container 2, instead of manufacturing them by an injection moulding process it is also possible to make them for example by extrusion or by a wrapping process or the like from several layers fixed to each other, in each case as a sandwich component, wherein the end walls 6, 10 of the container 2 and outer housing 4 are tightly sealed for example by a thermal shaping process, a blowing process or the like.

In FIGS. 8 to 10 is shown another embodiment of a holding device 1, the same reference numbers as in FIGS. 1 to 7 again being used for the same components.

The holding device 1 again consists of the inner container 2 which is inserted or pressed into the outer housing 4 designed as a protective layer 3, and supported therein stationarily e.g. by means of a press fit. Both the container 2 and the outer housing 4 are again sealed with end walls 10 and 6 in an end region, that is, the end 9 or the end 5. Further, both the container 2 and the outer housing 4 are open in the region opposite the end 9 or end 5, that is, the end region 11 as well as the end 7, and can be sealed in this region by means of the sealing device 8.

The sealing device a for sealing the open region of the holding device 1 in turn again consists of the can 16, the stopper 15 arranged therein and the retaining washer 20. In order to achieve fixing of the stopper 15 in position in the direction of the longitudinal axis 26 in the cap 16, it comprises the attachment 17 which projects radially outwards beyond the sealing surface 14 and extends all round and which is reliably supported on the one hand on the collar 19, which faces towards the end 7 of the outer housing 4 and is connected to the cap 16 in form-locking relationship, and on the other hand on the retaining washer 20 arranged at a distance therefrom in the direction of the longitudinal axis 26. This washer is in turn again fixed in the direction of the longitudinal axis 26 by a bead 50 arranged on the side of the retaining washer 20 opposite the stopper 15 and protruding radially inwards, that is, in the direction of the longitudinal axis 26. The attachment 17 in this case protrudes outwards beyond the sealing surface 14 all round by about the wall thickness of the outer housing 4.

The collar 19 of the cap 16 is supported at the end edge 16 on the sealing device 8 when the latter is fully fitted or screwed on. In order to make it easier to fit or screw the sealing device 8 onto the outer housing 4, on the inside of the cap 16 are shown schematically parts of thread turns 51, 52, 53. These helically arranged thread turns cooperate with web-like or knob-like projections 54 which protrude outwards over the circumference in the region of the end edge 18 of the outer housing 4 and are arranged in certain regions. Thus the whole sealing device 8 and hence also the stopper 15 can be inserted in the open end 7 of the outer housing 4 until an end face 55 of the stopper 15 facing towards the end 5 comes into contact with an end edge 56 of the container 2 in the end region 11 thereof.

As can further be seen from FIG. 8, the outer housing 4 has the length 12, seen the direction of its longitudinal axis 26. The end wall 6 of the outer housing 4 has a thickness 57 in the region of the end 5. Further the end edge 56 of the container 2 is spaced apart by the length difference 13 from the end edge 18 of the outer housing 4 in the direction of the end wall 6, as a result of which a length 58 arises for the container 2. This length difference 13 is to be kept to exactly, as otherwise there is no sealing contact of the end face 55 of the stopper 15 with the end edge 56 of the container 2, which in this region can then result in ambient air being drawn in through the outer housing 4, and hence the vacuum of the holding device 1 which has built up in the interior 59 is reduced or the holding device 1 becomes unusable as a result.

In order tow to be able to keep exactly to this length difference 13 between the container 2 and the outer housing 4 over both their lengths 58 and 12 or the thickness 57 of the end wall 6, both the end wall 6 and the end wall 10 have a special design, as can best be seen from FIG. 9. Another problem also arises in the process of manufacturing the container 2 or outer housing 4, as they are made in each case in a separate injection moulding or blowing process, and also the inaccuracies in the region of the sprue of the components must be taken into account. Thus the ball cup-shaped end wall 10 of the container 2 in the region of the longitudinal axis 26 has a passage through the material in the direction of the open end region 11, as a result of which a free space 60 is formed between the outer surface 24 of the container 2 and the inner surface 21 of the outer housing 4. In this free space 60 a sprue 61 for the container 2 is also arranged and shown schematically in the region of the longitudinal axis 26.

In the region of the longitudinal axis 26 the inner surface 21 of the outer housing 4 comprises a projection 62 which is shaped convexly in the direction of the open end 7 and also extends into the free space 60 Further, in dashed lines is shown the ball cup shape of the inner surface 21, to which the thickness 57 of the end wall 6 is also referred.

In the region of the plane 27 which is arranged normally to the longitudinal axis 26 and passes more or less through the centre of the ball cup-shaped end wall 6 or 10, it is indicated that the outer surface 24 of the container 2 forts an offset 63 constantly increasing in the direction of the plane 27, from the inner surf ace 21 of the outer housing 4. This offset 63 is continuous all round over the whole circumference and serves on the one hand so that the ball cup-shaped outer surface 24 of the end wall 10 of the container 2, in a region 64 which is arranged centrally to the longitudinal axis 26 and can preferably be approximately between 60° and 140°, fits exactly against the inner surface 21 of the outer housing 4 and on the other hand so that the air remaining in the offset 63 can still be drawn off in the direction of the end region 11 through the depressions 31 distributed over the circumference of the container 2. In this process of extraction or evacuation of the interior 59, the remaining air in the free space 60 is also drawn off via the depressions 31 and the cavity formed by the offset 63. The depressions 31 form the channels 42 which run between the outer surface 24 of the container 2 and the inner surf ace 21 of the outer housing 4 and extend from the sealed end in the direction of the open end.

FIG. 10 shows a top view of the container 2 and the outer housing 4 with the sealing device 8 lifted off Here can be seen the depressions 31 arranged on the outer surface 24 of the container 2, which in the present embodiment are offset from each other at an angle of 120°, distributed over the circumference, and extend into the region of the plane 27 and there open out into the cavity formed by the offset 63. As a result, again for assembly of the container 2 with the outer housing 4 it is ensured that the air trapped between the two end walls 6 and 10 can escape through the depressions 31 in the direction of the open end 7, as a result of which satisfactory and easy assembly is ensured. In order to facilitate this assembly process, or due to the process of manufacturing the container 2 and the outer housing 4, these are of conical construction, and both the inner surface 21 of the container 2 comprises the inner cone 22 and the outer surface 24 comprises the outer cone 25, which taper at the cone angle 23 in the direction of the sealed end. The cone angle 23 is here between 4° and 0.1°.

Likewise are shown the projections 54 which are arranged in the region of the end edge 18 and protrude outwardly beyond an outer surface 65 and which cooperate with the thread turns 51 to 53 of the cap 16. The individual projections 54—in the present embodiment three projections 54 are provided—are offset from each other at an angle of about 120°.

It is again essential in this embodiment that the container 2 is bade of a liquid-tight, in particular water-tight, material such as e.g. glass, plastic, such as in particular polypropylene (PP), polyethylene (PE) or the like. A gas-tight material, in particular polyethylene terephthalate (PET), is used as the preferred material for the outer housing 4. A highly elastic and self-sealing material such as e.g. pharmaceutical rubber, silicone rubber or bromobutyl rubber which is both gas-tight and liquid-tight is used as the material for the stopper 15 of the sealing device 8.

Care must further be taken that snag fitting of the end face 55 of the stopper 15 against the end edge 56 of the container 2 is ensured, in order to achieve gas-tight sealing in this region too. For this it is also necessary for both the lengths 12 and 58 to be kept to exactly relative to each other, as a result of which a minor deviation in the length difference 13 also arises Finally it should be pointed out that in the embodiments described above, individual parts have been shown disproportionately enlarged in order to improve understanding of the solution according to the invention. Furthermore, individual parts of the combinations of characteristics described above for the individual embodiments can also, in conjunction with other individual characteristics from other embodiments, form independent solutions according to the invention.

Above all the individual embodiments shown in FIGS. 1 to 3, 4, 5, 6, 7, 8 to 10 can form the subject of independent solutions according to the invention. The objects and solutions according to the invention in this respect can be found in the detailed descriptions of these figures.

I claim:

1. A holding device for liquids, which comprises (a) a container having a longitudinal axis and formed of a liquid-tight wall having a thickness defined between an outer surface and an inner surface, (1) the wall being sealed at one end of the container and (2) the container being open at an opposite end thereof, (b) an outer housing having a longitudinal axis and formed of a gas-tight wall having a thickness defined between an outer surface and an inner surface, (1) the wall being sealed at one end of the outer housing and (2) the outer housing being open at an opposite end thereof, (c) the container being inserted coaxially in the outer housing, with a substantial portion of the outer surface of the container wall contacting the inner surface of the outer housing wall without play whereby the container is held in the outer housing by a press fit, and (d) the outer surface of the container wall and the inner surface of the outer housing wall defining therebetween at least one continuous groove extending from the one sealed ends of the container and outer housing walls to the opposite open container and outer housing ends.

2. The holding device of claim 1, wherein the outer housing wall is resistant to elongation in the direction of the longitudinal axis.

3. The holding device of claim 1, wherein the container wall is resistant to elongation in the direction of the longitudinal axis.

4. The holding device of claim 1, wherein the container wall is comprised of more than one layer, the layers being laminated to each other.

5. The holding device of claim 1, wherein the container has a substantially elliptical cross-section at least at the sealed and open ends thereof, the elliptical cross-section having a large diameter and a small diameter extending perpendicularly thereto, the small diameter being at least 0.001 mm shorter than the large diameter.

6. The holding device of claim 1, comprising two diametrically oppositely arranged continuous grooves having ends at respective sides of the longitudinal axis and spaced from each other in the hemispherically shaped end of the container.

7. The holding device of claim 1, wherein the continuous groove has a depth of between 0.02 mm and 0.5 mm.

8. The holding device of claim 1, wherein the continuous grooves is a depression in the outer surface of the container wall forming a passage extending parallel to the longitudinal axis from the one end of the container towards the opposite open container end.

9. The holding device of claim 1, wherein the wall thicknesses are between 0.4 mm and 1.2 mm.

10. The holding device of claim 1, wherein the outer housing wall has a water vapor permeability of less than 1 $g/m^2.d$ and a gas permeability of less than 150 $cm^3/m^2.d.bar$.

11. The holding device of claim 1, wherein the sealed walls at the one ends of the container and outer housing are hemispherically shaped.

12. The holding device of claim 11, wherein the continuous groove extends in the outer surface of the container wall from the hemispherically shaped end of the container towards the opposite open container end.

13. The holding device of claim 1, wherein the container wall is gas-permeable.

14. The holding device of claim 13, wherein the container wall is made of plastic.

15. The holding device of claim 1, wherein the outer housing has a length exceeding the length of the container.

16. The holding device of claims 15, further comprising a gas-tight plug sealing the open ends of the outer housing and container, the outer housing and container walls having end edges at the open ends, and the plug sitting on the end edge of the container wall and comprising a flange projecting beyond the inner surface of the outer housing wall.

17. The holding device of claim 16, wherein the plug has a coaxially extending cylindrical sealing surface contacting the inner surface of the outer housing wall, the sealing surface having a length exceeding the difference between the lengths of the container and outer housing and extending to the flange.

18. The holding device of claim 11, wherein the inner surface of the outer housing wall and the outer surface of the container wall conically converge towards the sealed walls at the one ends of the outer housing and container.

19. The holding device of claim 18, wherein the conically converging outer and inner surfaces have the same diameter at the sealed walls at the one ends.

20. The holding device of claim 18, wherein the conically converging inner surface of the outer housing has a diameter which is smaller by at least 0.001 mm than the diameter of the outer surface of the container at the sealed walls at the one ends.

21. The holding device of claim 18, wherein the inner surface of the outer housing wall and the outer surface of the container wall conically converge under the same cone angle.

22. The holding device of claim 21, wherein the cone angle is between 0.2° and 4.0°.

23. A holding device for liquids, which comprises (a) a container having a longitudinal axis and formed of a liquid-tight wall having a thickness defined between an outer surface and an inner surface, (1) the wall being sealed at one end of the container and (2) the container being open at an opposite end thereof, (b) an outer housing having a longitudinal axis and formed of a gas-tight wall having a thickness defined between an outer surface and an inner surface, (1) the wall being sealed at one end of the outer housing, (2) the outer housing being open at an opposite end thereof, and (3) the outer surface of the container wall and the inner surface of the outer housing wall facing each other, (c) the container being inserted coaxially in the outer housing, at least one of the wall surfaces having circumferentially spaced ribs extending parallel to the longitudinal axis and contacting the facing wall surface without play whereby the container is held in the outer housing by a press fit, and (d) the ribs defining continuous grooves therebetween, (1) the continuous grooves extending from the one sealed ends of the container and outer housing walls towards the opposite open container and outer housing ends.

24. The holding device of claim 23, wherein the continuous grooves have a depth of between 0.02 mm and 0.5 mm.

25. The holding device of claim 23, wherein the outer container wall surface and the inner'surface of the outer housing wall have the circumferentially spaced ribs, the ribs on the outer container wall surface and the inner surface of the outer housing wall alternating with each other.

* * * * *